US009649641B2

(12) United States Patent
Demsia

(10) Patent No.: US 9,649,641 B2
(45) Date of Patent: May 16, 2017

(54) SPRING OPERATED SWING OUT ROTOR SYSTEM AND METHOD FOR A CENTRIFUGE

(71) Applicant: Anthony Walter Demsia, South Plainfield, NJ (US)

(72) Inventor: Anthony Walter Demsia, South Plainfield, NJ (US)

( * ) Notice: Subject to any disclaimer, the term of this patent is extended or adjusted under 35 U.S.C. 154(b) by 151 days.

(21) Appl. No.: 14/452,350

(22) Filed: Aug. 5, 2014

(65) Prior Publication Data

US 2016/0038951 A1 Feb. 11, 2016

(51) Int. Cl.
*B04B 5/04* (2006.01)
*B04B 15/00* (2006.01)

(52) U.S. Cl.
CPC ..... *B04B 5/0421* (2013.01)

(58) Field of Classification Search
CPC ..... B04B 5/0421
USPC ..... 494/16–21, 12, 31, 33, 43, 81; 422/548
See application file for complete search history.

(56) References Cited

U.S. PATENT DOCUMENTS 5,584,790 A * 12/1996 Bell
6,234,948 B1 * 5/2001 Yavilevich ..... B01L 3/5021 494/20
6,866,622 B2 * 3/2005 Aizawa ..... B04B 5/0421 494/20
2003/0186798 A1 * 10/2003 Aizawa ..... B04B 5/0421 494/20
2010/0167900 A1 7/2010 Rosenblum
2011/0111942 A1 * 5/2011 Piramoon ..... B04B 5/0414 494/16

* cited by examiner

*Primary Examiner* — Charles Cooley
(74) *Attorney, Agent, or Firm* — Larry Severin

(57) ABSTRACT

A spring operated swing out rotor system for a centrifuge includes a rotor with a rotor top and a rotor bay extending down from the rotor top, the rotor bay having a bay wall and a bay bottom; a carrier tray rotatably attached to a retaining element on the bay wall; and a compression-resistant element between the tray and the bay wall urging the tray to rotate away from the bay wall, so that when the rotor is at rest, the tray is maintained at a positive angle from vertical, and when the centrifuge spins the rotor, centrifugal force positions the tray at a vertical angle. The compression-resistant element may be a spring or soft foam.

9 Claims, 6 Drawing Sheets

SPRING OPERATED SWING OUT ROTOR SYSTEM AND METHOD FOR A CENTRIFUGE

BACKGROUND OF THE INVENTION

The present invention generally relates to centrifuges and more specifically to a spring operated swing out rotor system for a centrifuge.

Traditionally, there have been two types of centrifuge rotors, "angled rotors" and "swing out rotors". The rotor is the part of the centrifuge that spins during centrifugation and holds the vessel. Angled rotors hold the tube/vessel at an angle, usually somewhere in the area of 45°. This is the easier type of rotor to manufacture and therefore is usually less expensive. Swing out rotors are designed so that the tube or vessel is inserted vertically or sufficiently tilted so that the tubes will not spill, and during centrifugation, the rotor carrier (also called buckets, shields or inserts) "swings out" so that when spinning, the tube is held horizontally. The advantage to spinning the vessel horizontally is that the separation occurs in a way that produces the supernatant to be collected perfectly at the very bottom of the tube.

Swing out rotors often consist of a rotor and carrier. The conventional rotor has two retaining elements for each carrier. When at rest, the carrier is horizontal and holds the vessels vertical due to gravity alone, so that the sample tube or vessel does not require a cap or lid. During centrifugation, the centrifugal force swings the carrier so the vessels are in a horizontal position. When centrifugation is complete, the tubes revert to their original position due to gravity.

In an ordinary swing-out centrifuge, gravity alone holds the vessels vertical or sufficiently tilted before use, and then the centrifugal force rotates the vessels into a nearly-horizontal position. Before use, gravity delicately urges the default position of the carrier tray to be in a position to avoid spillage, but there is little or nothing else to maintain that orientation, so that the entire tray of vessels may rotate out of position and spill liquid if the system is bumped. During use, gravity opposes the centrifugal force, and therefore the tube might "droop" and not be perfectly horizontal. The rotor may have difficulty sustaining the vessels in a completely horizontal orientation.

It would be desirable to have a rotor where the carrier tray is sufficiently tilted before use so that the vessels will not spill, but the system benefits from the centrifugal forces to urge the vessels into a horizontal position when spinning.

SUMMARY OF THE INVENTION

In one aspect of the present invention, a device for a centrifuge includes a rotor with a rotor top and a rotor bay extending down from the rotor top, the rotor bay having a bay wall and a bay bottom; a carrier tray rotatably attached to a retaining element on the bay wall; and a compression-resistant element between the tray and the bay wall urging the tray to rotate away from the bay wall, so that when the rotor is at rest, the tray is maintained at a positive angle from vertical, and when the centrifuge spins the rotor, the centrifugal forces cause the tray to be held at a vertical angle.

In another aspect of the present invention, a device for a centrifuge, includes a rotor with a rotor top and a rotor bay extending down from the rotor top, the rotor bay having a bay wall and a bay bottom; a carrier tray rotatably attached to a retaining element on the bay wall; a compression-resistant element that includes either a spring or soft foam, between the tray and the bay wall urging the tray to rotate away from the bay wall, so that when the rotor is at rest, the tray is maintained at a positive angle from vertical, and when the centrifuge spins the rotor, the tray is held at a vertical angle; and a post at a center of the bay bottom. The tray has a tray wall, a floor at a lower end of the tray wall, and a lip on a side of the floor opposite the tray wall, the lip and floor have a notch opposite the tray wall, and the post fits into the notch so that the post and the compression-resistant element retain the tray in place when the rotor is at rest; the post further holds the rotor to the motor shaft of the centrifuge, so that when the motor shaft spins, the rotor spins; the retaining element on the bay wall includes an aperture on a top of the bay wall adjacent to the top of the rotor; the tray has a pivot arm on a back of the tray that extends out from the tray, and a head on a surface of the pivot arm that extends out from the pivot arm; the pivot arm passes through the aperture from a front side of the bay wall and the head is blocked by a back side of the bay wall so that the pivot arm is rotatably retained in the aperture, thereby rotatably attaching the tray to the rotor; and the tray carries a multi-well plate with sample wells oriented at a right angle to the tray, so that when the tray is vertical, the wells are horizontal.

In yet another embodiment of the present invention, a method for spinning a multi-well plate includes providing a rotor with a rotor top and a rotor bay extending down from the rotor top, the rotor bay having a bay wall and a bay bottom, a carrier tray rotatably attached to a retaining element on the bay wall, and a compression-resistant element between the tray and the bay wall urging the tray to rotate away from the bay wall, and a post at a center of the bay bottom; attaching the post of the rotor to a motor shaft of a centrifuge; carrying the multi-well plate in the tray so that a plurality of sample wells are perpendicular to the tray; maintaining the tray at a positive angle from vertical while the rotor is at rest; spinning the motor shaft with a centrifuge, thereby spinning the rotor; and compressing the compression-resistant element with centrifugal force while the rotor is spinning so that the compression-resistant element maintains the tray at a vertical angle.

DETAILED DESCRIPTION

Figure 1:
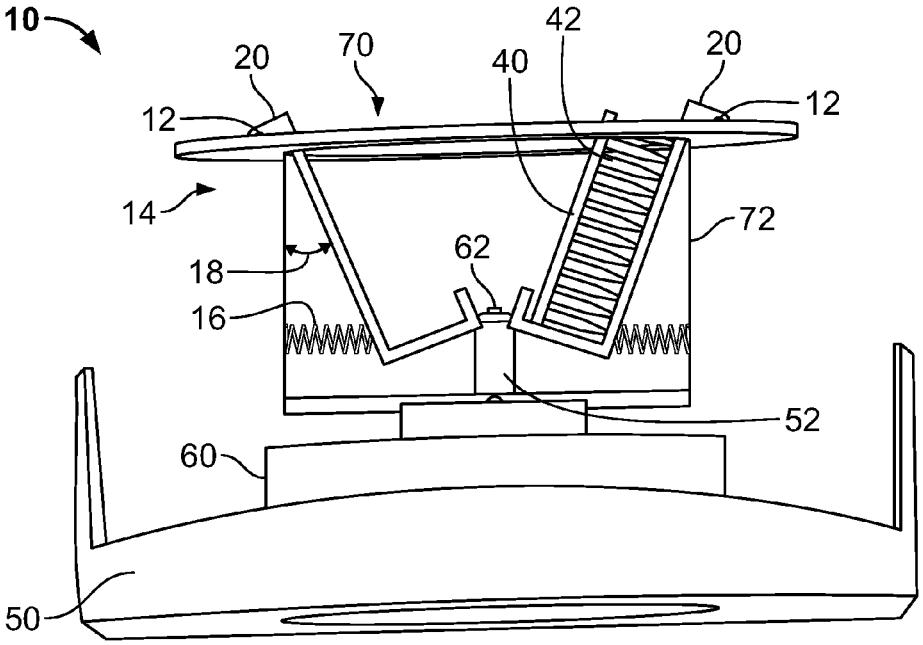
FIG. 1 depicts a side view of an embodiment of a rotor system at rest, according to the present invention.

The preferred embodiment and other embodiments, which can be used in industry and include the best mode now known of carrying out the invention, are hereby described in detail with reference to the drawings. Further embodiments, features and advantages will become apparent from the ensuing description, or may be learned without undue experimentation. The figures are not necessarily drawn to scale, except where otherwise indicated. The following description of embodiments, even if phrased in terms of "the invention" or what the embodiment "is," is not to be taken in a limiting sense, but describes the manner and process of making and using the invention. The coverage of this patent will be described in the claims. The order in which steps are listed in the claims does not necessarily indicate that the steps must be performed in that order.

An embodiment of the present invention generally provides a spring operated swing out rotor system and method for a laboratory centrifuge. The sample wells are held in a 100% horizontal orientation when spinning, and are forced into a tilted upright orientation by a spring when at rest.

In an embodiment, a round rotor or carrier frame is spun by a centrifuge having a motor with a motor shaft. The rotor and its components may be made mostly of rigid plastic or metal. A hollow connection post at the center of the rotor attaches the rotor to the motor shaft with a fastening screw such as a metal thumb screw. The motor shaft of the centrifuge sits inside the hollow connection post of the rotor. A threaded bore or cavity in the top of the motor shaft matches the threaded shaft of the thumb screw. An aperture in the top of the connection post aligns with the bore of the motor shaft. The user puts the rotor onto the centrifuge, the aperture aligns with the bore of the motor shaft, and the user screws the thumb screw through the aperture into the shaft. The head of the thumb screw holds the base of the rotor to the motor shaft so that the centrifuge will spin the rotor and its contents.

An embodiment of a rotor has a flat, round top with a large rectangular indented bay that forms two opposing walls and 2 side walls. The connection post of the rotor is at the bottom center of the bay. The bay's walls each have a pair of retaining elements or pivot points at the top to hold carrier trays for multi-well plates or racks of vessels. An embodiment of the retaining element is an open slot in the wall of the bay that extends into the top surface of the rotor, and engages with the pivot arms and pivot arm retaining heads of the carrier tray. The tray has a tray wall that may be held in a 100% vertical orientation when spinning at a moderate or higher speed (so the wells are perfectly horizontal for maximum centrifugation effect), and forced into a tilted orientation by a spring or foam when at rest (so the wells are tilted to avoid spillage). The pivot arms extend into the slots in the wall and the heads on the pivot arms prevent the arms from slipping out until they are removed. The rotor connection post at the center of the rotor also holds the trays in place by fitting into a notch in the bottom floor of the trays when the trays are pressed against the post by the spring.

In an embodiment, the pivot arms of the trays extend directly out from positions on the back, upper portion of the tray. The arms are not necessarily at the top of the tray, so that the top of the tray may extend above the pivot arms and out and above the top of the rotor bay. The outer surface of the arms has a retaining head, which may be in the shape of a crescent, "C", horseshoe shaped, or mostly a circular wall with the back of the crescent toward the tray. The pivot arm retaining heads are held behind the bay wall, but the arms allow some free play within the wall slot so that the tray my pivot relative to the wall. The arms can be compressed slightly inward for installation, but then the strong, rigid plastic will urge the arms to return to a straight orientation.

In an embodiment, to install the tray, the arms may be compressed together (either by a manufacturer or user) so that the heads at the end of the pivot arms can fit into the slots. The arms are pressed into the slot until the head clears the wall, and then the head is allowed to click in place. The open portion of the "C"-shaped head helps the arms slide into the slot, but then retains the arm once it clicks in.

When the arms are straight, the back part of the head cannot clear the slot so it stays behind the wall. The tray is held in place because the top of the tray is rotatably attached to a wall of the rotor bay, the lower rear of the tray is pushed forward by compression-resistant element (spring or foam) into the connection post, and the lower front of the tray has a notch in the tray lip which is stopped and held by the connection post. To remove the tray, a user may compress the arms together again until the heads clear the slots, so the arms can be removed.

In embodiments of the present invention, a spring holds a carrier tray sufficiently tilted before use so that the wells, vessels, or test tubes of liquid or other fluid to be rotated will not spill. Without the spring, gravity alone would tend to make the wells horizontal, not vertical, and the wells would spill. In an embodiment, when the centrifuge spins fast enough, the springs of the present invention will become completely compressed, and the wells may be held perfectly horizontal. Gravity, in addition to centrifugal force, will tend to horizontally align the wells during rotation.

In an embodiment, when at rest, a compression spring or soft foam compression-resistant element behind the carrier may position a multi-well plate at an angle such as 45° to 80° from horizontal, which is the same as 10° to 45° angle from vertical. The wells or vessels (such as test tubes) are perpendicular to the plane of the tray and multi-well plate. A connection post in the base of the rotor allows a thumb screw to hold the base to a motor, so that the motor spins the rotor. The compression spring compresses against the rotor wall during centrifugation so that when spinning, the multi-well plate is vertical (like the tray wall) and the wells are held in a horizontal position. Gravity and centrifugal force urge the wells to become horizontal, so when the spring compresses, the wells may be held perfectly horizontally.

Embodiments of carrier trays may have pivot arms that extend out from the tray and into a wall of the rotor. The length of the arms measured from the aperture to the rotor bay wall where the spring attaches matches the expected length of the centrifugally-compress spring so that the tray is vertical when the rotor is at an operational speed. When the rotor slows down and stops, the spring returns to a relatively uncompressed length, and forces the tray into a tilted position.

As depicted in FIG. 1, an embodiment of a rotor system 10 for a centrifuge 50 may include a rotor 14 with a box-shaped rotor bay 70 that extends down from the round flat top of the rotor. One or two carrier trays 20 may be rotatably attached at retaining elements 12 near the top of bay walls 72 of the rotor bay 70. The tray on the right in FIG. 1 also has a multi-well plate 40 installed, with 96 sample wells 42. Other example embodiments may have 85, 100, or other numbers of sample wells per plate. The left-side multi-well plate has been excluded from the Figures for clarity, but in the preferred embodiment, both sides would have a multi-well plate. In an embodiment, when at rest, a spring 16 maintains the trays 20 at a positive angle-from-vertical 18 (i.e. a greater than zero angle between the tray wall and the bay wall). The angle 18 may be from 10° to 45°. A preferred angle is 15°, which is enough to prevent pre-filled sample wells in the tray from spilling. A connection post 52 holds the rotor 14 to a motor 60 of the centrifuge 50. Post 52 may also limit how far the carrier trays 20 will be pushed out by the springs 16. In an embodiment, a thumb screw 62 may be screwed and unscrewed through the connection post 52 into a motor shaft 64 to allow the rotor 14 to be installed or removed. Alternate embodiments may have soft foam as a compression-resistant element that compresses during centrifugation and resiliently expands back to its original size when at rest.

Figure 2:
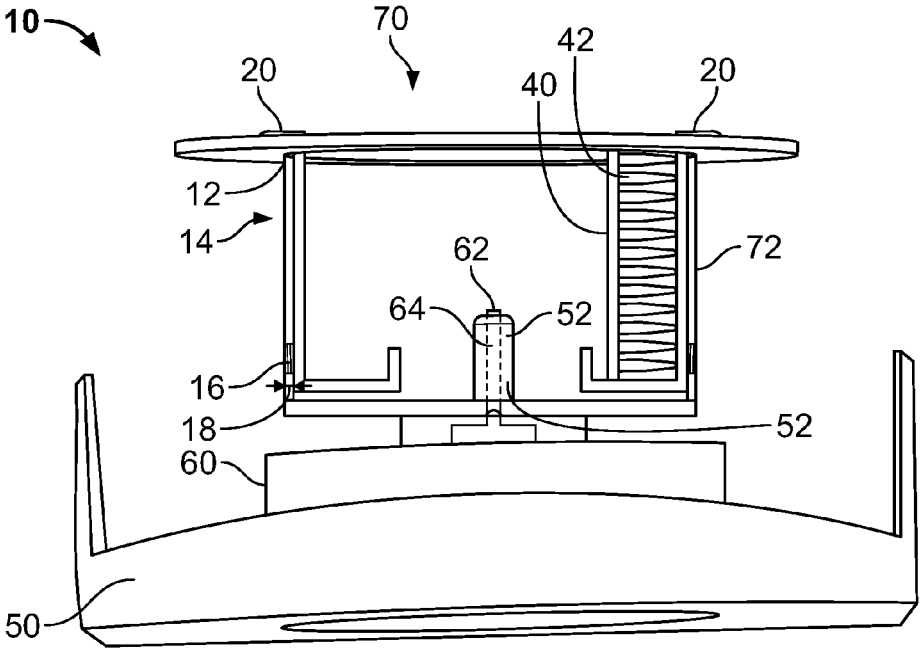
FIG. 2 depicts the rotor system of FIG. 1 while spinning.

As shown in the embodiment of FIG. 2, when the motor 60 is spinning, the spring 16 becomes compressed and the tray 20 is held at a substantially 0° (vertical) angle 18. The sample wells 42 (or test tubes or other vessels) in the rotor 14 are substantially horizontal, but the sample wells will not spill the liquid they contain because of centrifugal force. When the motor 60 slows and stops spinning, the spring 16 will urge the tray 20 back to the tilted rest position.

As depicted in FIGS. 1 and 2, spring 16 may include a coil spring or other compression-resistant element having a helical, mechanical coil. Embodiments of a compression-resistant element may have a major axis with a variable length that shortens when the compression-resistant element is compressed during centrifuge spinning, as shown in FIG. 2, and grows when the compression-resistant element returns to an uncompressed shape, as shown in FIG. 1. This lengthening of the major axis is what forces the tray to rotate away from the bay wall. Spring 16 may be positioned between the tray 20 and the bay wall 72 with a first end of spring 16 pressing against the bay wall 72 and a second end of spring 16 pressing directly against a back, lower portion of the tray 20. This connection near the bottom of the tray may apply forces from the compression-resistant element directly to the lower portion of the tray, distal from the retaining elements 12.

Figure 3:
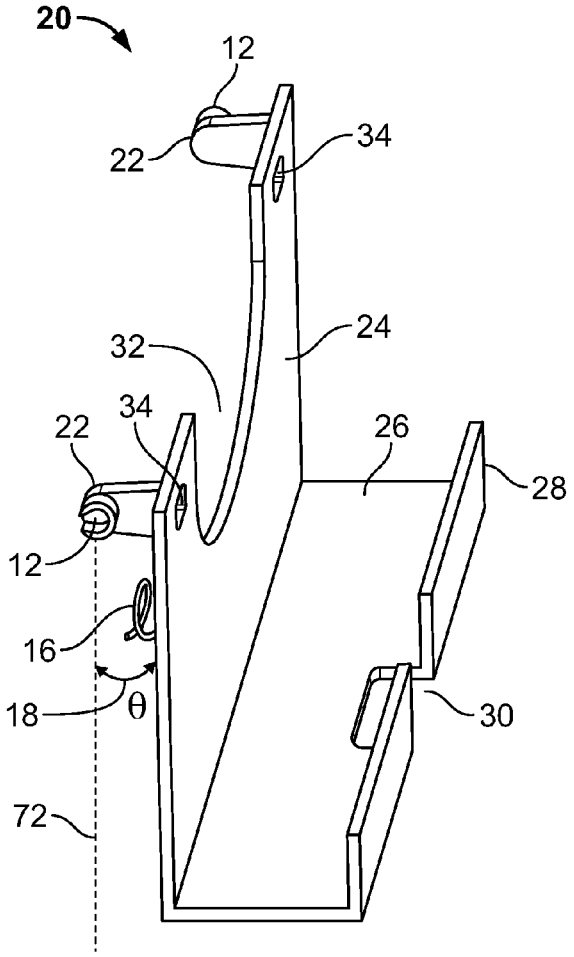
FIG. 3 depicts a right, perspective view of an embodiment of a carrier tray in a vertical position, according to the present invention.

FIG. 3 depicts an embodiment of a carrier tray 20 during centrifuge spinning. The spring 16 is compressed when the rotor spins, so that the tray 20 is at a substantially 0° angle 18 relative to vertical (the tray is vertical and the wells in the multi-well plates are horizontal). Embodiments of a carrier tray 20 have pivot arms 22 that rotatably attach to retaining elements at the top of the rotor bay, so that the tray 20 is free to rotate about the retaining elements. Embodiments of retaining elements in the rotor may include bay wall slots or apertures in the rotor and corresponding pivot arms 22 with pivot arm retaining heads 23 that fit into the bay wall slots so that the tray can swivel yet is retained within the rotor bay. The pivot arm retaining heads 23 prevent the arms from slipping out of the bay wall slots. Carrier tray 20 may have a tray wall 24 for a multi-well plate to lean against, a tray floor 26 at a lower end of the wall for the plate to rest upon, and a tray lip 28 on a side of the floor opposite the wall that helps retain the tray. Embodiments of a tray 20 may have a notch 30 in the lip 28 and floor 26 that is adapted to wrap around and press against the connection post in the center of the rotor, to help retain the tray 20 in the correct position when at rest. The tray wall 24 may have a cutout area 32 near the top and additional cutouts 34 in the tray wall 24, to reduce weight and make it easier to handle and remove the multi-well plate or vessel rack to be held by the tray.

Figure 4:
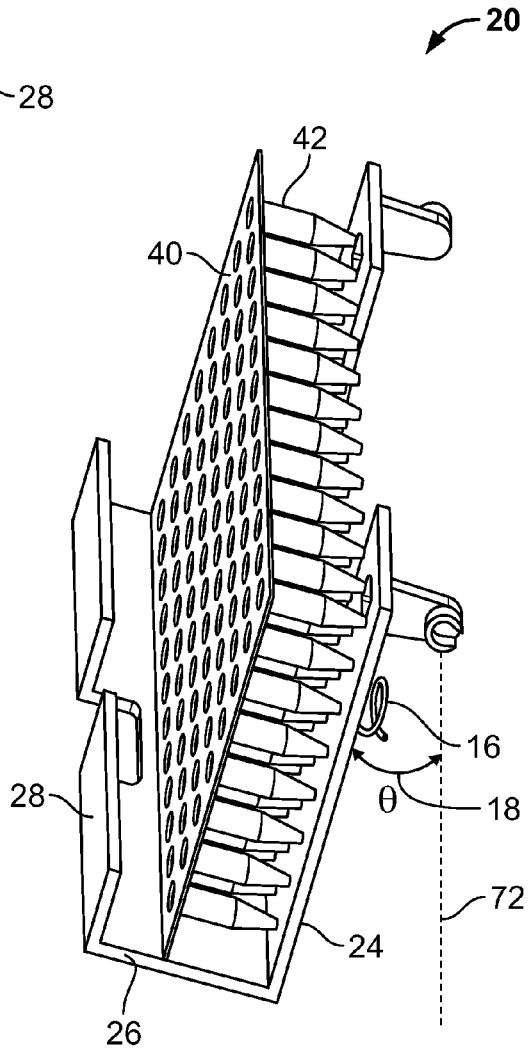
FIG. 4 depicts a left, perspective view of an embodiment of a carrier tray with vessels at rest, according to the present invention.

FIG. 4 depicts an embodiment of a carrier tray 20 with a multi-well plate 40 and sample wells 42, at rest. The multi-well plate 40 is retained by the tray floor 26 and tray lip 28. The bottoms of the wells themselves may rest against the tray wall 24. The tray 20 is attached to the retaining elements of the rotor by pivot arms 22 with pivot arm heads 23 in the shape of a crescent with the back of the crescent toward the tray. When at rest, the spring 16 pushes the carrier tray 20 into a tilted position, so that the angle from vertical 18 is, for example, 15°.

Figure 5:
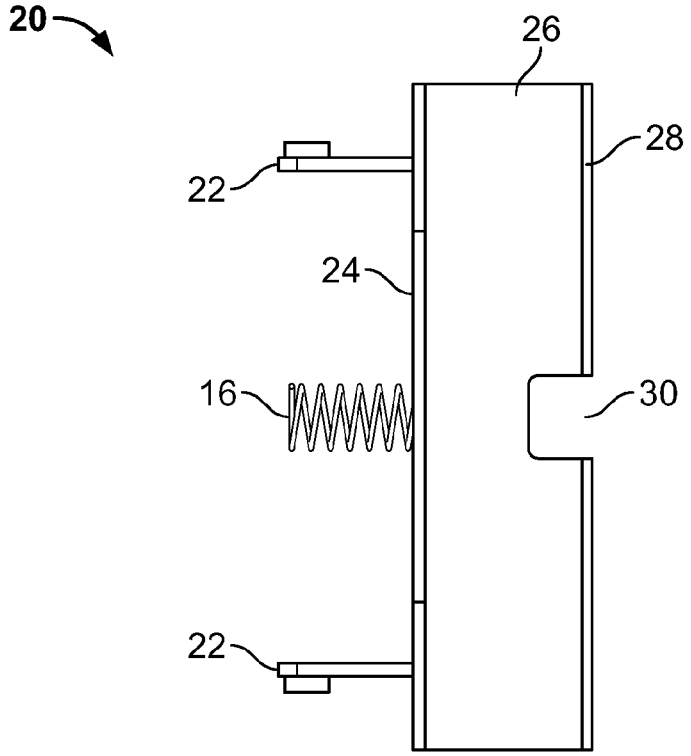
FIG. 5 depicts a top view of the carrier tray of FIG. 3.
Figure 6:
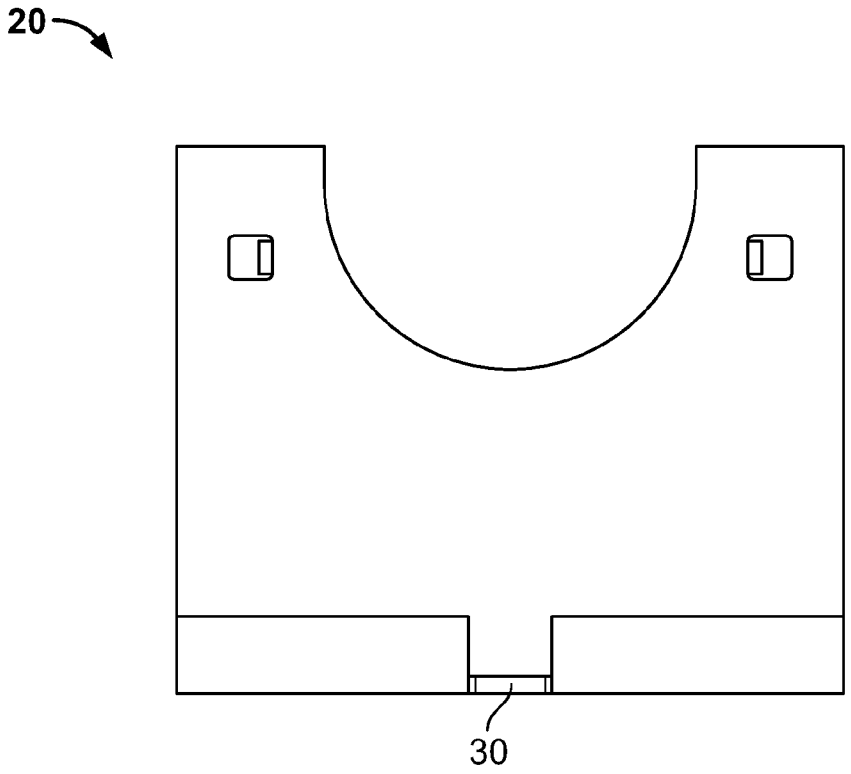
FIG. 6 depicts a front view of the carrier tray of FIG. 3.
Figure 5B:
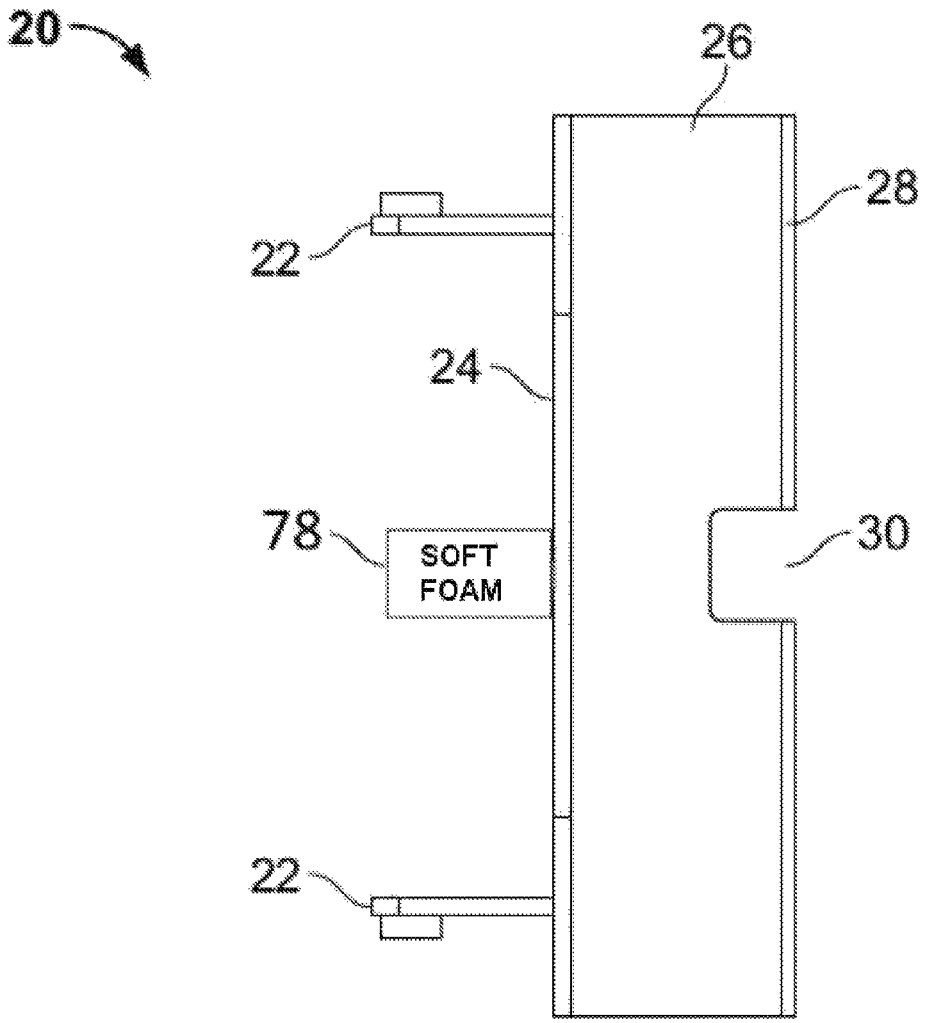
FIG. 5B depicts a top view of an alternate embodiment of a carrier tray according to the present invention.

FIGS. 5, 5B, and 6 depict further views of an embodiment of a carrier tray 20 having pivot arms 22 with heads 23, a tray wall 24, a tray floor 26, and a tray lip 28. FIG. 5 depicts an embodiment with a coil spring 16, and FIG. 5B depicts an embodiment of a carrier tray having a soft foam compression-resistant element 78.

Figure 7:
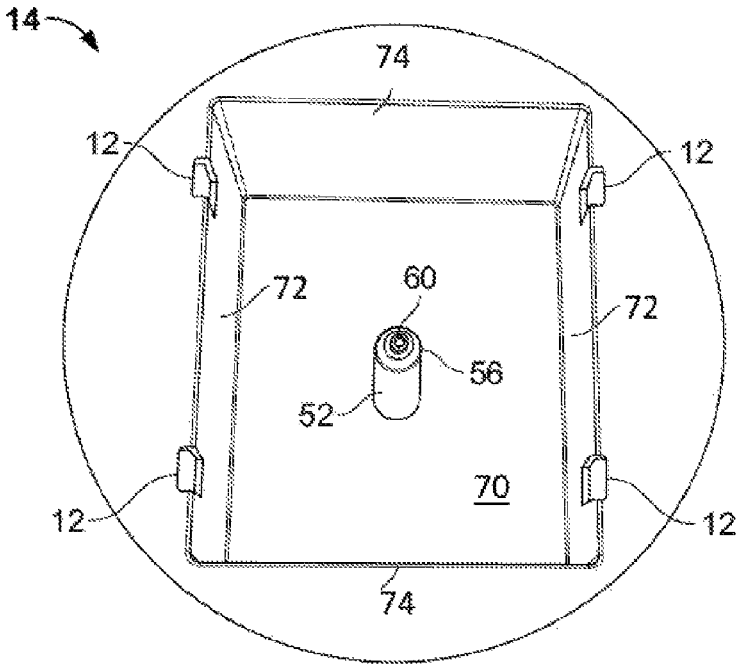
FIG. 7 depicts an embodiment of a rotor according to the present invention.

FIG. 7 depicts an embodiment of a rotor 14. The rotor 14 is like a box adapted to hold two carrier trays, with a base, two bay walls 72, and two bay side walls 74. Rotor 14 has four retaining elements 12 on the bay wall 72 that align with the pivot arms of the carrier trays. The retaining elements 12 are adapted to rotatably retain the trays within the rotor bay 70, so that when the device is spun, the trays will rotate from a tilted position into a vertical position and the multi-well plates in the trays will be held horizontally. An embodiment of retaining elements 12 may include a pair of bay wall slots 76 or cut-outs at the top of the bay wall 72. Rotor 14 also has a connection post 52 near the center of the bay 70 that allows the shaft of the motor to firmly attach the rotor to the motor and hold it in place.

Figure 8:
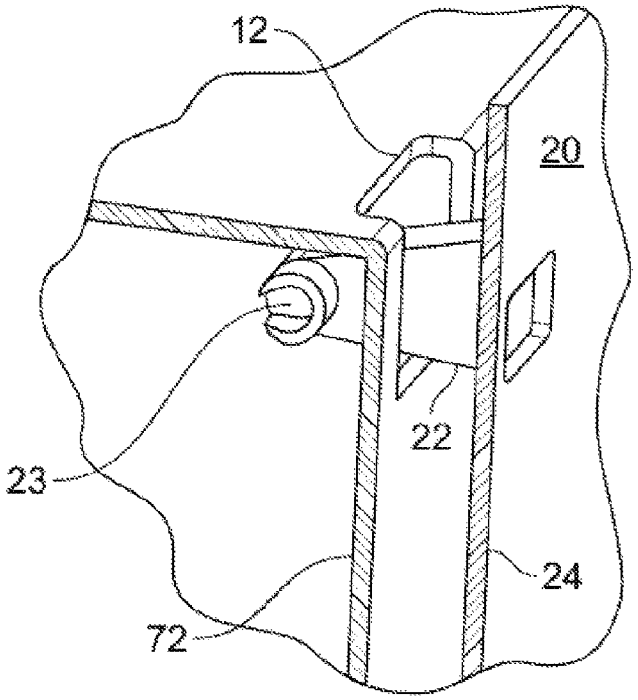
FIG. 8 depicts a partial view of the rotor of FIG. 7.

FIG. 8 depicts an embodiment of a carrier tray 20 having a pivot arm 22 on the tray wall 24 with a pivot arm retaining head 23. Pivot arm 22 passes through retaining element 12 of the bay wall 72, which may be a simple rectangular aperture.

Figure 9:
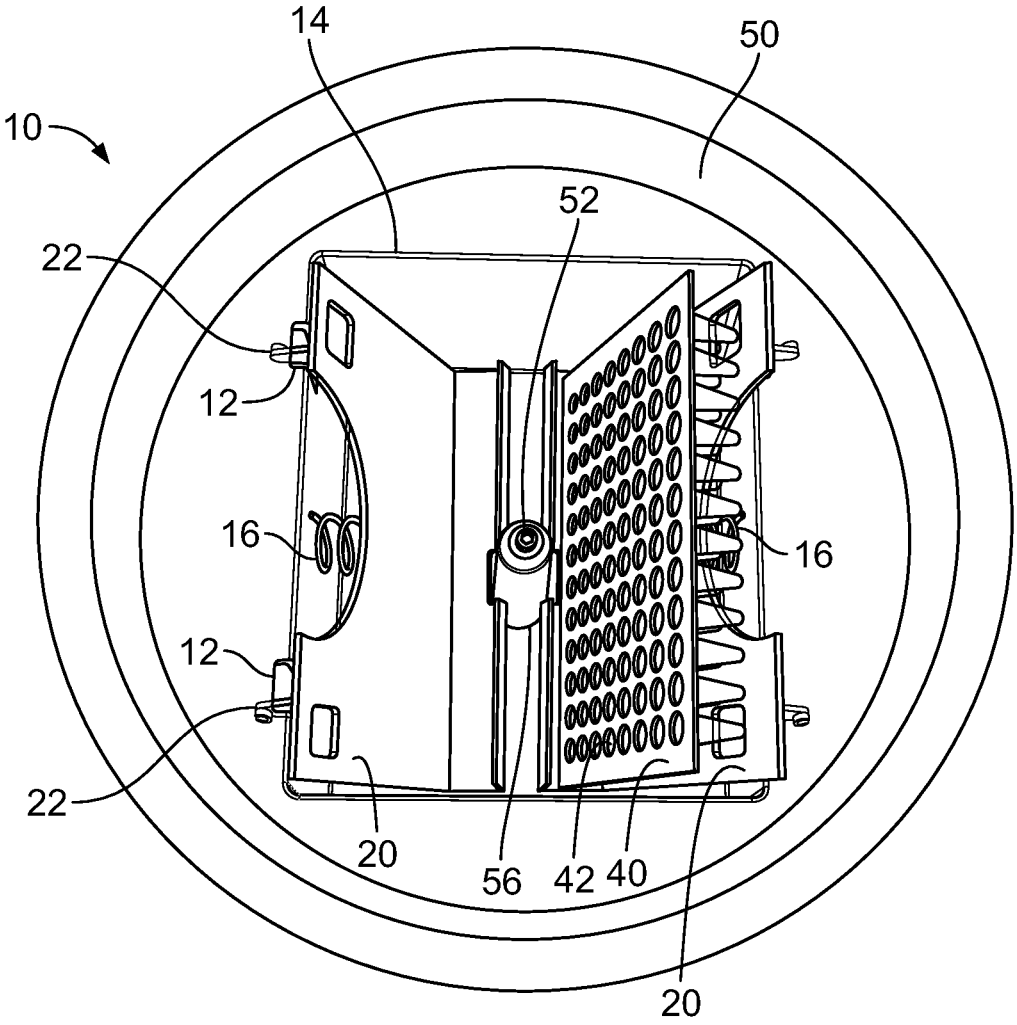
FIG. 9 depicts a top, perspective view of an embodiment of a rotor system according to the present invention.

FIG. 9 depicts an embodiment of a rotor system 10 ready for use. A motor 60 has a central connection post 52 that surrounds the motor shaft 60 to hold the rotor 14 in place and secure the connection post 52 to the motor. Centrifugal force presses the carrier trays 20 against the springs 16 so that the multi-well plates 42 are vertical and the sample wells are held in a horizontal position. The motor 60 spins to apply centrifugal force to the contents of the sample wells in the multi-well plate 40.

I claim:

1. A device for a centrifuge, comprising:

a rotor with a rotor top and a rotor bay extending down from the rotor top, the rotor bay having a bay wall and a bay bottom;

a carrier tray rotatably attached to a retaining element on the bay wall; and a compression-resistant element between the tray and the bay wall urging the tray to rotate away from the bay wall, so that when the rotor is at rest, the tray is maintained at a positive angle from vertical, and when the centrifuge spins the rotor, the tray is held at a vertical angle;

a post at a center of the bay bottom;

wherein the tray has a tray wall, a floor at a lower end of the tray wall, and a lip on a side of the floor opposite the tray wall;

the lip and floor have a notch opposite the tray wall; and the post fits into the notch so that the post and the compression-resistant element retain the tray in place when the rotor is at rest.

2. A device for a centrifuge, comprising:

a rotor with a rotor top and a rotor bay extending down from the rotor top, the rotor bay having a bay wall and a bay bottom;

a carrier tray rotatable attached to a retaining element on the bay wall; and a compression-resistant element between the tray and the bay wall urging the tray to rotate away from the bay wall, so that when the rotor is at rest, the tray is maintained at a positive angle from vertical, and when the centrifuge spins the rotor, the tray is held at a vertical angle;

wherein:

the retaining element on the bay wall includes an aperture on a top of the bay wall adjacent to the top of the rotor;

the tray has a pivot arm on a back of the tray that extends out from the tray, and a head on a surface of the pivot arm that extends out from the pivot arm; and the pivot arm passes through the aperture from a front side of the bay wall and the head is blocked by a back side of the bay wall so that the pivot arm is rotatably retained in the aperture, thereby rotatably attaching the tray to the rotor.

3. The device of claim 2, wherein:

the bay wall includes a second retaining element at the top of the bay wall in horizontal alignment with the retaining element of claim 2; and the tray includes a second pivot arm on the back of the tray that corresponds to the second retaining element so that the pivot arm of claim 2 aligns with the retaining element of claim 2 and the second pivot arm aligns with the second retaining element.

4. The device of claim 2, wherein the head on the pivot arm is crescent shaped so that an open side of the crescent allows the pivot arm to be inserted into the aperture during assembly, and then a back side of the crescent engages with the back of the bay wall to retain the head behind the bay wall.

5. A device for a centrifuge, comprising:

a rotor with a rotor top and a rotor bay extending down from the rotor top, the rotor bay having a bay wall and a bay bottom;

a carrier tray rotatably attached to a retaining element on the bay wall; and a compression-resistant element between the tray and the bay wall urging the tray to rotate away from the bay wall, so that when the rotor is at rest, the tray is maintained at a positive angle from vertical, and when the centrifuge spins the rotor, the tray is held at a vertical angle;

wherein the compression-resistant element is a soft foam having a first size when the rotor is at rest, and resiliently compressing to a smaller second size when the rotor spins.

6. A device for a centrifuge, the device comprising:

a rotor with a rotor top and a rotor bay extending down from the rotor top, the rotor bay having a bay wall and a bay bottom;

a carrier tray rotatably attached to a retaining element on the bay wall;

a compression-resistant element that includes either a spring or soft foam, between the tray and the bay wall urging the tray to rotate away from the bay wall, so that when the rotor is at rest, the tray is maintained at a positive angle from vertical, and when the centrifuge spins the rotor, the tray is held at a vertical angle; and a post at a center of the bay bottom;

wherein the tray has a tray wall, a floor at a lower end of the tray wall, and a lip on a side of the floor opposite the tray wall, the lip and floor have a notch opposite the tray wall, and the post fits into the notch so that the post and the compression-resistant element retain the tray in place when the rotor is at rest;

the post further holds the rotor to a motor shaft of the centrifuge, so that when the motor shaft spins, the rotor spins;

the retaining element on the bay wall includes an aperture on a top of the bay wall adjacent to the top of the rotor;

the tray has a pivot arm on a back of the tray that extends out from the tray, and a head on a surface of the pivot arm that extends out from the pivot arm;

the pivot arm passes through the aperture from a front side of the bay wall and the head is blocked by a back side of the bay wall so that the pivot arm is rotatably retained in the aperture, thereby rotatably attaching the tray to the rotor; and the tray carries a multi-well plate with sample wells oriented at a right angle to the tray, so that when the tray is vertical, the wells are horizontal.

7. The device of claim 6, wherein the compression-resistant element is soft foam.

8. The device of claim 6 wherein the compression-resistant element is a spring.

9. A method for spinning a multi-well plate, the method comprising:

providing a rotor with a rotor top and a rotor bay extending down from the rotor top, the rotor bay having a bay wall and a bay bottom, a carrier tray rotatably attached to a retaining element on the bay wall, and a compression-resistant element between the tray and the bay wall urging the tray to rotate away from the bay wall, and a post at a center of the bay bottom;

attaching the post of the rotor to a motor shaft of a centrifuge;

carrying the multi-well plate in the tray so that a plurality of sample wells are perpendicular to the tray;

maintaining the tray at a positive angle from vertical while the rotor is at rest;

spinning the motor shaft with a centrifuge, thereby spinning the rotor; and compressing the compression-resistant element with centrifugal force while the rotor is spinning so that the compression-resistant element maintains the tray at a vertical angle;

wherein the compression-resistant element is a soft foam having a first size when the rotor is at rest, and resiliently compressing to a smaller second size when the rotor spins.

* * * * *